US008065950B2

(12) United States Patent
Kaminsky

(10) Patent No.: US 8,065,950 B2
(45) Date of Patent: Nov. 29, 2011

(54) AUTOMATIC PISTOL

(75) Inventor: Victor Anatolevich Kaminsky, Ufa (RU)

(73) Assignee: Hans Wrage & Co. GmbH, Hamburg (DE)

( * ) Notice: Subject to any disclaimer, the term of this patent is extended or adjusted under 35 U.S.C. 154(b) by 0 days.

(21) Appl. No.: 12/599,809

(22) PCT Filed: Apr. 24, 2008

(86) PCT No.: PCT/RU2008/000262
§ 371 (c)(1),
(2), (4) Date: Aug. 24, 2010

(87) PCT Pub. No.: WO2008/140352
PCT Pub. Date: Nov. 20, 2008

(65) Prior Publication Data

US 2011/0017058 A1 Jan. 27, 2011

(30) Foreign Application Priority Data

May 11, 2007 (RU) ..... 2007119128

(51) Int. Cl.
*F41A 3/62* (2006.01)

(52) U.S. Cl. ..... 89/196; 89/190; 89/186; 89/184; 89/171; 89/176

(58) Field of Classification Search ..... 89/196, 89/190, 186, 184, 187.01, 171, 173, 176
See application file for complete search history.

(56) References Cited

U.S. PATENT DOCUMENTS

| | | | | | |
|---|---|---|---|---|---|
| 743,002 | A * | 11/1903 | Knoble | 89/145 |
| 1,083,872 | A * | 1/1914 | Berthier | 89/140 |
| 1,176,254 | A * | 3/1916 | Smith | 89/138 |
| 1,418,021 | A * | 5/1922 | Reifgraber | 89/147 |
| 1,428,304 | A * | 9/1922 | Stevenson | 89/154 |
| 1,455,880 | A * | 5/1923 | Hammond | 89/145 |
| 2,997,924 | A * | 8/1961 | Rosebush | 89/155 |
| 3,069,976 | A * | 12/1962 | Stevens, Jr. | 89/147 |
| 3,306,168 | A * | 2/1967 | Blumrick | 89/191.01 |
| 3,866,516 | A * | 2/1975 | Frisoli | 89/190 |
| 4,461,203 | A * | 7/1984 | Jawdat | 89/154 |
| 6,257,116 | B1 * | 7/2001 | Moczijdlower et al. | 89/155 |

FOREIGN PATENT DOCUMENTS

| | | |
|---|---|---|
| EP | 0573093 | 12/1993 |
| RU | 2156938 C1 | 9/2000 |
| RU | 2166720 C1 | 5/2001 |

* cited by examiner

*Primary Examiner* — Stephen M Johnson
*Assistant Examiner* — Jonathan C Weber
(74) *Attorney, Agent, or Firm* — Thomas M. Freiburger

(57) ABSTRACT

An automatic pistol essentially consists of an immovable barrel, a breech with a firing pin and a cartridge extractor, a breech frame, a spring-loaded device for the removal of gas with a gas piston and a gas cylinder, a firing mechanism and a magazine. The barrel is fitted with an end piece, which is located in the lower part of the rear end of the barrel. The design of the breech allows for the displacement of its front part downwards, when the breech is in its front end position. The front part of the breech is fitted with side locking lugs. The corresponding locking grooves are located in the cavities on the end piece of the barrel. The gas piston has an opening for ejecting the cartridge casing. In the course of the backward movement, the gas piston unlocks the breech and draws it back. In the forward movement, the breech is carried forward and pushed downwards. The gas cylinder is located at the front part of the barrel and encompasses the barrel. Along the length of the barrel gas ducts are fixed.

4 Claims, 4 Drawing Sheets

AUTOMATIC PISTOL

Figure 1:
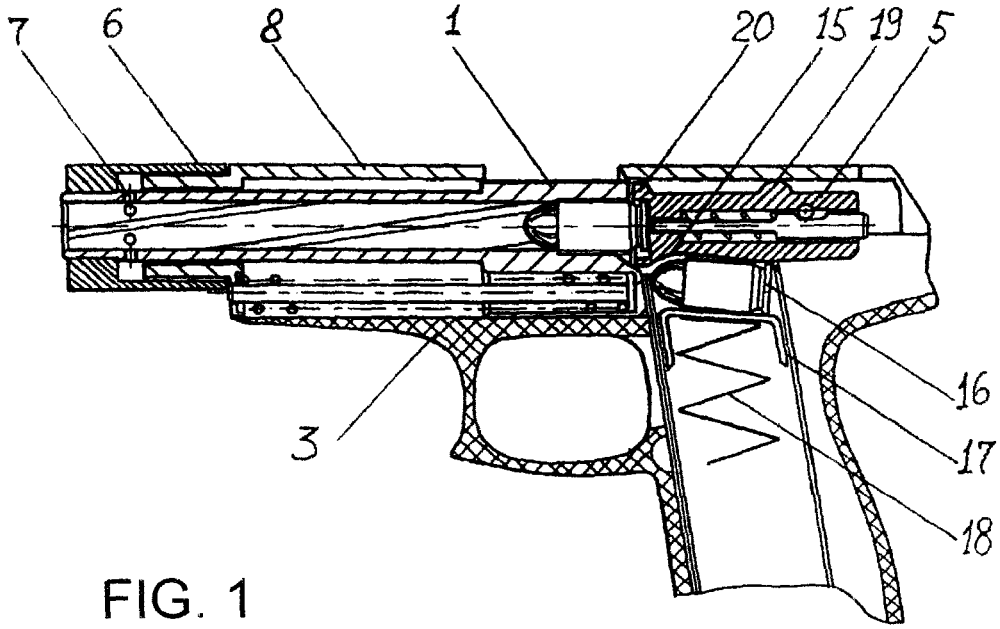

This application claims priority from RU 2007119128, filed May 11, 2007, and PCT/RU2008/000262, filed Apr. 24, 2008.

Technical Area

The invention described here concerns the design engineering of firearms, in particular the design engineering of automatic firearms, which are reloaded by the offtake of powder gases (gas pressure loader).

CURRENT STATE OF TECHNOLOGY

The Karabiner S (East German variation of the SKS-45 Simonov self-loading carbine) is a self-loading firearm whose main components include an immovable barrel with a device for the removal of gas, consisting of a gas cylinder, a gas pipe, a gas piston and a spring-loaded gas rod, as well as a breech casing with a locking lug. The breech of a self loading firearm contains a breechblock carrier and a locking piece with a guide edge. The breech is shut by drawing the back end of the locking piece behind the locking lug of the breech casing (Instructions for Handling Firearms, Military publishing house of the Ministry of Defence of the Union of the Soviet Socialist Republics, Moscow, 1973, pages 180-188). The disadvantages of the Karabiners S include the complicated design, caused by the long and solid breech casing and a long locking piece. In addition, the locking lug is situated substantially below the shaft of the gun barrel and at a great distance from the rear end of the barrel, such that the cartridge casing and the locking piece are displaced at the discharge of fire, which adversely affects the shot accuracy.

The technical solution presented here closely resembles the design engineering of automatic firearms, which are comprised of an immovable barrel, a breech with a firing pin, a cartridge extractor, a breech frame, a spring-loaded device for the removal of gas with a gas piston and a gas cylinder, a firing mechanism and a magazine.

The movable breech frame is fixed to the spring-loaded gas piston. The muzzle nut has an opening for the projectile. The muzzle nut is fixed firmly to the barrel and is situated in front of the barrel opening. The hammer is located horizontally under the breech. At the rear side of the hammer, a locking lug is located, which locks the breech (Patent RF N° . 2156938, MPK$^8$ E41A9100, F41C3/00, F41A5/18, published on the 27$^{th}$ of Sep. 2000). The disadvantage of the automatic firearm as described above is a lack of reliability with the device for the removal of gas. As the projectile leaves from the muzzle nut, the gas pressure in the gas chamber decreases rapidly, as a large amount of powder gas escapes through the opening of which the diameter corresponds to the diameter of the barrel. The gases press against the gas piston only momentarily, which is not sufficient for its reliable operation. In addition, the external dimensions of the firearm are increased by the presence and use of the device for the removal of gas under the gun barrel. The parts of the breech frame, the hammer, and the hammer shaft must be extremely solid and robust, which means that the design engineering of the firearm is made more complex and thus the manufacture is made more difficult. The placing of the locking mechanism substantially below the shaft of the gun barrel increases the risk that the breech is displaced at the discharge of fire and that the cartridge casing expands and jams/wedges. As a result, the reliability of the firearm and the shot accuracy are adversely affected. The shot accuracy is also worsened, as the locking lug is located substantially below the shaft of the gun barrel and at a great distance from the rear end of the barrel, such that the cartridge casing and the locking piece are displaced at the discharge of fire. The transfer of movement from the gas piston to the breech takes place with the help of the breech frame and a pin lying crossways, which makes the design engineering of the firearm more complex.

DESCRIPTION OF THE INVENTION

The purpose of the invention described here is the simplification of the design engineering and the manufacture of firearms, as well as the increase of their reliability and the improvement of their battle features.

This problem can be solved as follows:

An automatic pistol is comprised essentially of an immovable barrel, a breech with a firing pin, a cartridge extractor, a spring-loaded device for the removal of gas with a gas piston and a gas cylinder, a firing mechanism and a magazine. The barrel is fitted with an end piece, which is located in the lower part of the rear end of the barrel. The design of the breech allows for the displacement of its front part downwards, when the breech is in its front end position. The front part of the breech is fitted with side locking lugs. The corresponding locking grooves are located in the cavities on the end piece of the barrel. The gas piston has an opening for ejecting the cartridge casing. In the course of the backward movement, the gas piston unlocks the breech and draws it back. In the forward movement, the breech is carried forward and pushed downwards. The gas cylinder is located at the front part of the barrel and encompasses the barrel. Along the length of the barrel there are gas ducts fixed.

The end piece, which is located under the rear end of the barrel, the breech, which is pushed downwards in its front end position, the locking lugs on the sides of the front part of the breech and the locking grooves in the cavities on the end piece of the barrel allow for the possibility of compactly positioning the elements of the locking mechanism, which must be specially robust, directly in front of the rear end of the barrel. This design of the locking mechanism allows for a reduction in the strain on the breech frame and on the rear part of the breech and for a reduction in the number of reinforcing elements needed. This would simplify the design and the manufacture of the firearm, eliminate additional elements of the locking mechanism and as a result simplify the design of the locking mechanism. In addition, the breech can be positioned on the shaft of the gun barrel, such that the load can be better shared and the possibility for the displacement of the breech from the shaft of the gun barrel at the discharge of fire is excluded. This measure would substantially increase the shot accuracy. With this design of the locking elements, the locking lugs can be fixed in the free spaces on the sides of the breech. Their size and number can be increased, which would increase the reliability of the design.

The opening in the gas piston; which is intended for the ejection of the cartridge casing, as well as its ability to lift, to unlock and to draw back the breech in its backward movement and in its forward movement to carry the breech forward and push it downwards, create the possibility of using only one part—the gas piston—for the creation of the kinetic energy or momentum in the device for the removal of gas, for transferring this energy to the breech and for controlling the breech—opening, closing, fastening. This would considerably simplify the design, manufacture, disassembling and cleaning of the firearm. The application of a single detail—a longer gas piston, whose front part moves in the barrel and whose rear part is guided along the grooves which are located next to the shaft of the barrel—would eliminate the vibration, the increased friction and the shocks, which are inevitably caused when various moving parts interact with each other, thus allowing the entire mechanism to function more steadily and more reliably.

After the discharge of firing, the powder gases are channeled through the gas ducts on the front part of the barrel into the gas cylinder, which encompasses the barrel. After the projectile has passed the gas ducts, which are located along the length of the barrel, the powder gasses are rapidly and evenly diverted into the gas cylinder, such that the gas piston receives a stronger momentum and the reliability of the firearm is increased. The bottom of the gas chamber takes on the function of a compensator under high pressure from the powder gases, which reduces recoil, increases the stability of the firearm at the discharge of fire and improves the shot accuracy.

SHORT EXPLANATION OF THE DIAGRAMS

The efficiency of the invention is explained with the aid of the attached diagrams.

FIG. 1 shows the longitudinal section of an automatic pistol. The gas piston and the breech are in the front end position; the front part of the breech is pushed downwards.

Figure 2:
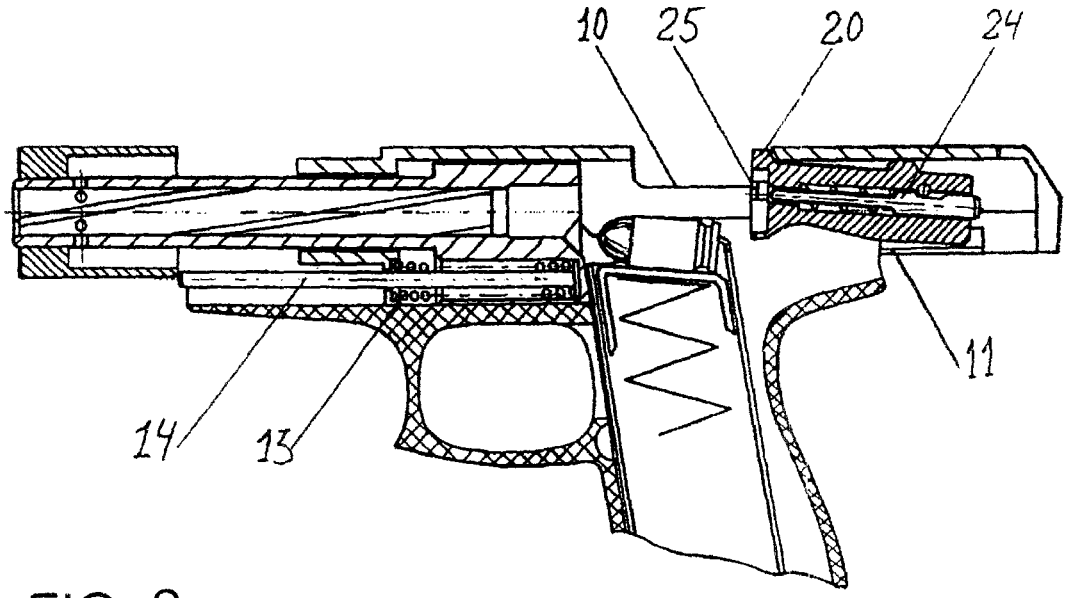

In FIG. 2, the gas piston and the breech are in the back end position.

Figure 3:
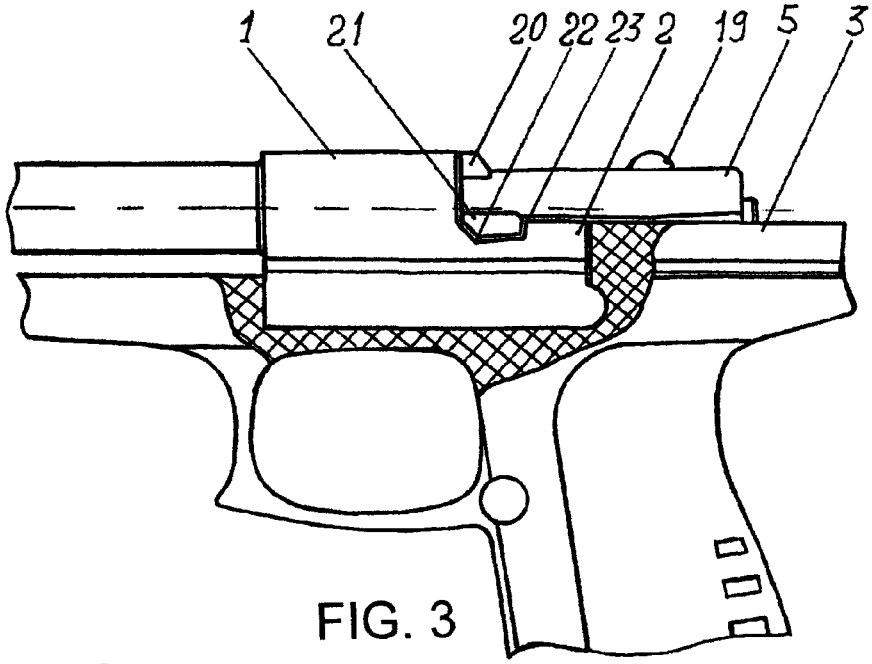

FIG. 3 shows the cross section of the breech frame and the rear part of the barrel with the end piece. The breech is pushed downwards.

Figure 4:
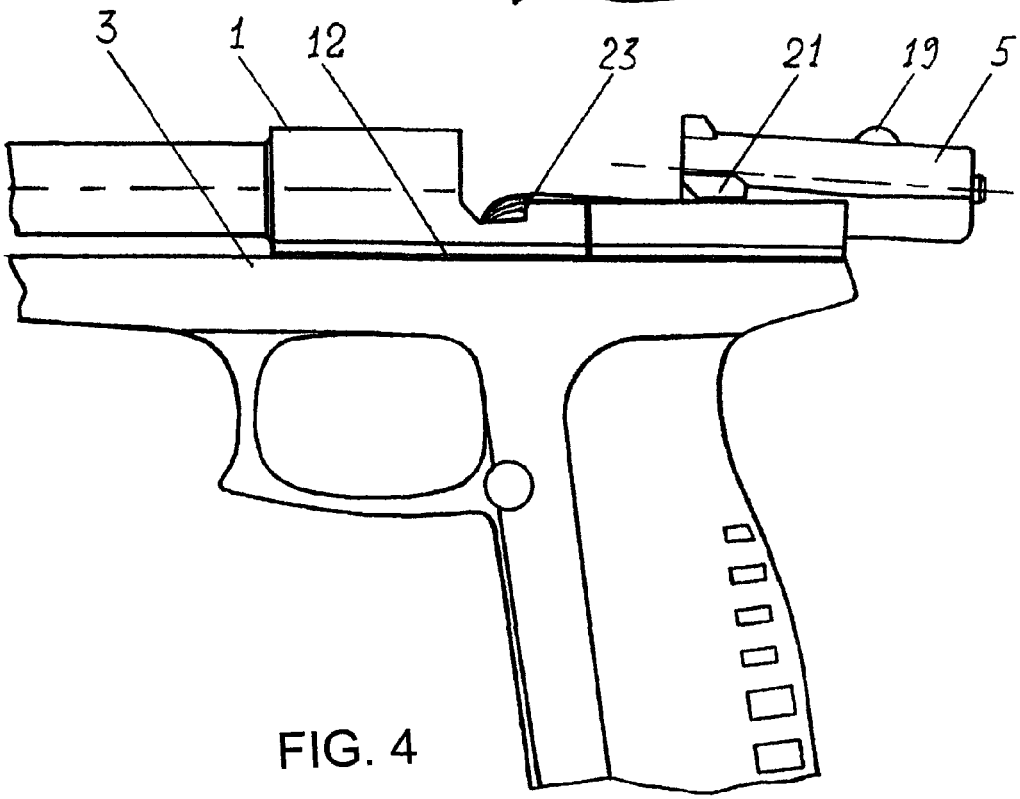

In FIG. 4, the rear part of the barrel with the end piece, the breech frame and the breech in its back end position are shown.

Figure 5:
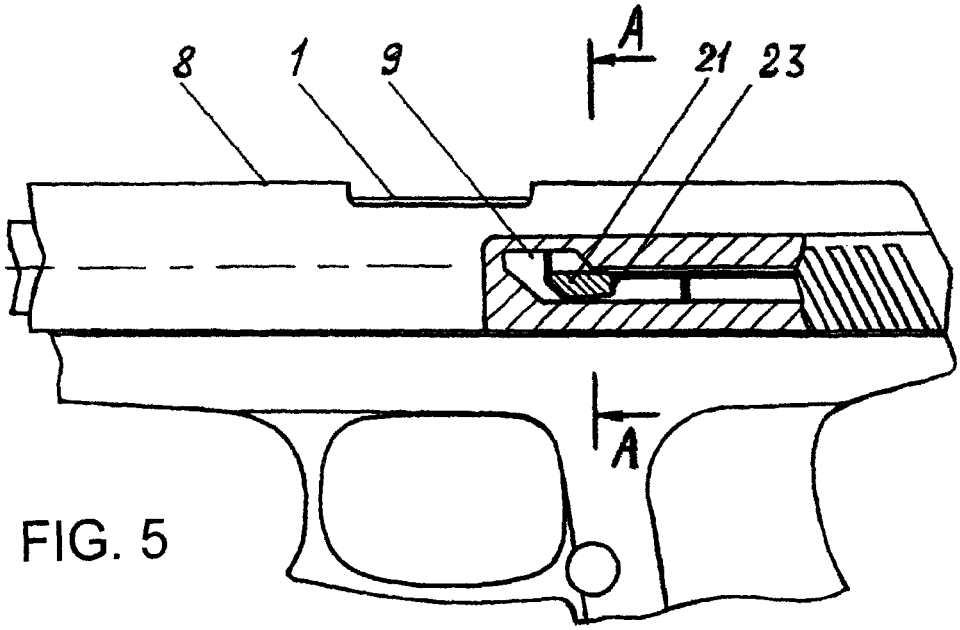

FIG. 5 shows the cross section of the locking curve in the gas piston and the locking lug of the breech. The breech is shut.

Figure 6:
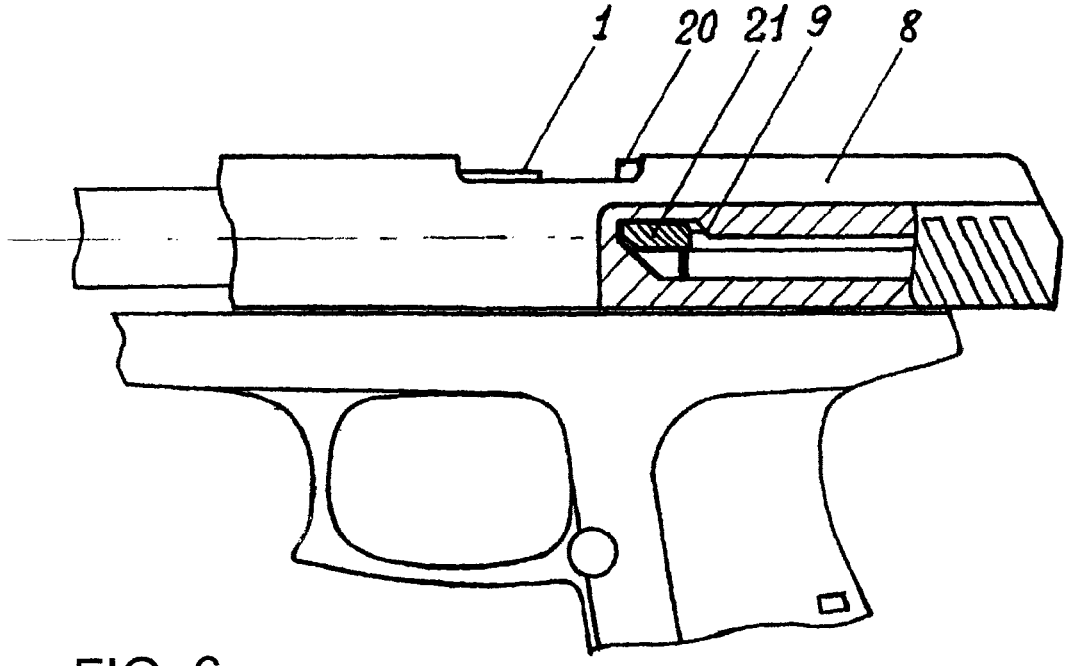

On FIG. 6, the gas piston and the breech are drawn backwards.

Figure 7:
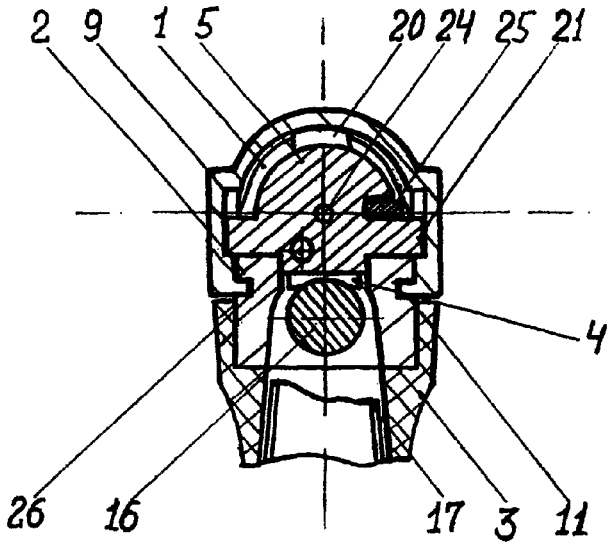

FIG. 7 shows a cross-section A-A of the parts, which are shown in FIG. 5.

POSSIBLE APPLICATION OF THE INVENTION

The automatic pistol consists of an immovable barrel 1 with and end piece 2, which is built in to the breech frame 3. The guide duct 4 of the breech 5 is intended for the end piece. The gas cylinder 6 encompasses the front part of the barrel. The gas chamber is affixed to the barrel by means of a bolted connection (not shown), which simplifies assembly and disassembly of the firearm. The gas ducts 7 are located along the length of the barrel. The gas piston 8 is built in to the gas cylinder. The lengthened part of the gas piston is designed as a breech slide/carriage. On the side areas of the breech carriage are located the locking curves 9, which control the function of the breech 5, the opening for ejecting the cartridge casing 10 and the guides 11, by which the gas piston moves in the breech frame 3 and the end piece 2. The guide grooves 12 for the gas piston are located in the breech frame and the end piece. The return spring 13 and the spring rod 14 are located under the barrel. The breech 5 has a groove 15, which is located above the head piece of the upper cartridge 16 of the magazine 17. The spring 18 of the magazine presses the rear part of the cartridge against the breech and pushes the front part of the breech downwards. At the point where the cartridge touches the breech is the bearing 19, which causes the displacement of the breech downwards. Above, on the front part of the breech is the locking lug 20, which interacts with the opening for the ejection of the cartridge casing 10. At the side areas the locking lugs 21 are fixed. The end piece of the barrel is fitted with grooves 22 and locking lugs 23. The breech contains a firing pin 24, the cartridge extractor 25 and the ejector rod 26.

Mode of operation of an automatic pistol:

Upon releasing the hammer (not shown) the firing pin 24 impacts the primer of the cartridge. A shot is fired. After the projectile has passed the gas ducts 7 on the barrel 1, the powder gases fill the gas cylinder 6. The gas piston 8 is moved backwards along the guide grooves 12 by the pressure of the powder gases and it presses the return spring together with the spring rod 14. The gas piston slides from the locking lug 20 of the breech and unblocks the breech. The locking curves in the grooves 9 of the gas piston lift the locking lugs 21 of the breech. The breech rests on the bearing 19; its front part moves upwards, the locking lugs 21 come out of the grooves 22 of the end piece and unblock the locking lugs 23. The locking lug 20 of the breech catches in the opening 10 of the gas piston. The gas piston presses with the front parts of the locking curves 9 against the locking lugs 21 and draws the breech 5 backwards. The cartridge casing is taken out of the cartridge loader of the barrel 1 with the cartridge extractor 25, caught by the ejector rod 26 and ejected from the firearm through the opening for the ejection of the cartridge casing 10. The breech 5 moves backwards in the breech frame 3 and tenses the hammer (not shown). After the gas piston 8 has reached its rear end position, it moves forwards under the pressure of the return spring 13 in the barrel 1 along the guide grooving 12 and presses against the locking lug 20, which is located in the opening for the ejection of the cartridge casing 10, and presses the breech 5 forwards. The breech moves in the breech frame 3 over the end piece 2 and through the guide duct 4 forwards and presses the next cartridge out of the magazine 17 in to the cartridge loader of the barrel 1. The gas piston 8 is directed into the gas cylinder 6, the breech reaches its front end position, the locking lugs 21 lie above the grooves 22 of the end piece, the groove 15 is located in the breech above the head piece of the upper cartridge 16 in the magazine 17. The pressure of the upper cartridge from the magazine is transferred onto the breech at the point of the bearing 19. The gas piston draws further forwards and strikes with an edge the opening 10 against the locking lug 20 and displaces the breech downwards. The breech rests on the bearing 19; its front part is displaced downwards. The locking lugs 21 catch in the grooves 22. They are blocked by the locking lug 23, such that the breech 5 shuts the barrel 1. The locking lug 20 is located in its lower position; the gas piston 8 is pushed onto the locking lug 20 and secures the breech. The locking curves 9 of the gas piston 8 hold the locking lug 20 in its lower position. The gas piston reaches its front end position and strikes against the front side of the gas chamber 6.

INDUSTRIAL APPLICATION

The automatic pistol described above has good battle features, is reliable and proves itself compared to other firearms on account of its simple design, which significantly simplifies its manufacture.

I claim:

1. An automatic pistol comprising an immovable barrel, a breech with a firing pin and a cartridge extractor, a slidable spring-loaded sleeve device for removal of gas including a gas piston, a gas cylinder fixed with the barrel and receiving powder gases from firing of the pistol, the sleeve device being slidable from a forward position within the gas cylinder such that powder gases entering the gas cylinder project the sleeve device rearwardly against the spring loading, a firing mechanism and a magazine for cartridges, the barrel being fitted with an end piece at a lower part of a rear end of the barrel, the breech being movable rearward and forward, the breech having a configuration which causes the front end of the breech to move downwardly when in a forward position and to tip upwardly when moved to the rear position, the breech further including locking lugs positioned to engage into locking grooves or recesses formed in the end piece of the barrel to hold the breech locked in the forward position when the breech is restrained from tipping the forward end of the breech upwardly, and the spring-loaded sleeve device, in the course of rearward movement after firing of the pistol, being configured to remove a restraint on the breech and to cause the breech to move rearward, causing the front end of the breech to tip upwardly, and in forward movement of the spring-loaded sleeve device, being configured to carry the breech forward and move the front end of the breech downwardly to again restrain the breech in the forward position.

2. The automatic pistol of claim 1, wherein the spring-loaded sleeve device has an opening for ejection of a cartridge casing after firing.

3. The automatic pistol of claim 1, wherein the magazine stores a fresh cartridge below the breech when the slidable sleeve device is in a forward position, the magazine including a spring which pushes the fresh cartridge upward to a position in front of the breech when the breech has been moved rearward, and the fresh cartridge then being positioned in the path of the breech when moved forward, such that the breech pushes the fresh cartridge into a position for firing as the breech is carried forward to the forward position.

4. The automatic pistol of claim 1, wherein the barrel includes a series of gas ducts near the front of the barrel, communicating with the gas cylinder.

* * * * *